United States Patent [19]

LePrevost

[11] 4,042,236

[45] Aug. 16, 1977

[54] TENNIS GAME METHOD AND APPARATUS

[76] Inventor: Dale Alan LePrevost, 4 Silver Terrace, Ocala, Fla. 32670

[21] Appl. No.: 579,412

[22] Filed: May 21, 1975

[51] Int. Cl.[2] ..... A63B 61/00

[52] U.S. Cl. ..... 273/29 R; 273/61 B; 273/DIG. 17

[58] Field of Search ..... 273/30, 29 R, 29 A, 273/213, 58 R, 58 A, 101.1, DIG. 24, 95 R, 61 R, 61 A, 17, 61, 95 H; 35/25; 240/2.25; 272/3

[56] References Cited

U.S. PATENT DOCUMENTS

| | | | |
|---|---|---|---|
| 3,039,773 | 6/1962 | Teeguarden et al. | 273/61 R |
| 3,039,773 | 6/1962 | Teeguarden | 273/61 R |
| 3,508,751 | 4/1970 | Meyer et al. | 273/101.1 |
| 3,717,343 | 2/1973 | Hartford | 273/30 |
| 3,971,560 | 7/1976 | Panosh | 273/30 |

FOREIGN PATENT DOCUMENTS

| | | | |
|---|---|---|---|
| 1,579,142 | 7/1969 | France | 273/213 |

*Primary Examiner*—Anton O. Oechsle
*Assistant Examiner*—T. Brown
*Attorney, Agent, or Firm*—Eugene F. Malin

[57] ABSTRACT

A ball game method and apparatus for visually connecting a highly reflective ball to the player's eye by transmitting light outwardly toward the ball and reflecting light off the ball back toward the player's eyes. A small reflecting angle is maintained between the transmitted light beam and the reflective light beam at the ball for tracking purposes. The apparatus includes the highly reflective ball and a lighting means connected to or adjacent a player's head for maintaining the small reflecting angle. The lighting means provides an electromagnetic output wave of such intensity that it reflects off the ball to provide a reflected return wave that is visible in the dark to the player transmitting the output wave and tracking the ball. The lighting means may be connected to the player's head for movement in relation to the moving ball.

9 Claims, 7 Drawing Figures

TENNIS GAME METHOD AND APPARATUS

BACKGROUND OF THE INVENTION

This invention relates to a method of playing a ball game when the ball is visually undetectable due to darkness. Further, this invention relates to a lighting means combined with a reflective ball to provide visual reflected light off of the ball for indicating the location of the ball.

In the past, tennis courts and the like had to be lighted by a plurality of high powered lighting means to illuminate the entire court to near daylight conditions. Such lighting means are expensive to install and maintain, and are expensive to operate.

BRIEF DESCRIPTION OF THE PREFERRED EMBODIMENT

A ball game method and apparatus for visually connecting a reflective ball to a player's eye in the dark by transmitting an electromagnetic output wave to the ball to provide a reflective wave from the ball to the player's eyes. The method and apparatus will, under conditions of darkness that would ordinarily make the ball untrackable, provide a visually trackable ball. The apparatus includes an electromagnetic wave device or lighting device for providing an output wave or light beam and a highly reflective ball for receiving an output wave. A small reflecting angle is maintained between the transmitted output wave or light beam and the reflective wave or beam at the ball in order to provide a high intensity reflective wave or beam that is visible to the eyes of the player in the darkness. The lighting device is positioned in relation to a player's eyes to provide the proper reflecting angle in order to provide a non-complex visual system.

The illuminating device may be connected to the player's head for automatic movement in relation to a player's head in order to direct a wide or narrow beam of light toward the moving ball when playing a game such as tennis. The illuminating device includes an electromagnetic output wave or lighting means powered by a portable battery that is strong enough to provide a visible reflected wave or beam from the ball to the player's eyes. The illuminating device is positioned to provide the maximum reflective wave intensity from the minimum intensity output wave or lighting means. A relatively small reflecting angle is maintained to provide a maximum reflective wave. The player can track the ball during a game by the reflected beam of light when it is ordinarily too dark to follow the ball.

The ball may include a reflective paint coating or a glass bead reflective coating or reflective fibers or a reflective outer skin.

It is an object of this invention to provide a method of playing a ball game in the darkness when the ball is undetectable by providing a reflective ball and an electromagnetic output wave device for viewing and tracking the ball by the reflected wave from the ball.

It is another object of this invention to provide an economical and energy saving method of playing a ball game in the darkness.

It is another object of this invention to provide a highly reflective ball for tracking purposes.

It is another object of this invention to provide a glass bead reflective coating on a ball.

It is a further object to provide a lighting element, a power source connected to the lighting element and a head connecting means to provide a beam of light of an intensity that allows the user to track a ball in the darkness by the reflected light of the surface of the ball.

In accordance with these and other objects which will be apparent hereinafter, the instant invention will now be described with particular reference to the accompanying drawings.

DESCRIPTION OF ONE PREFERRED EMBODIMENT

Figure 1:
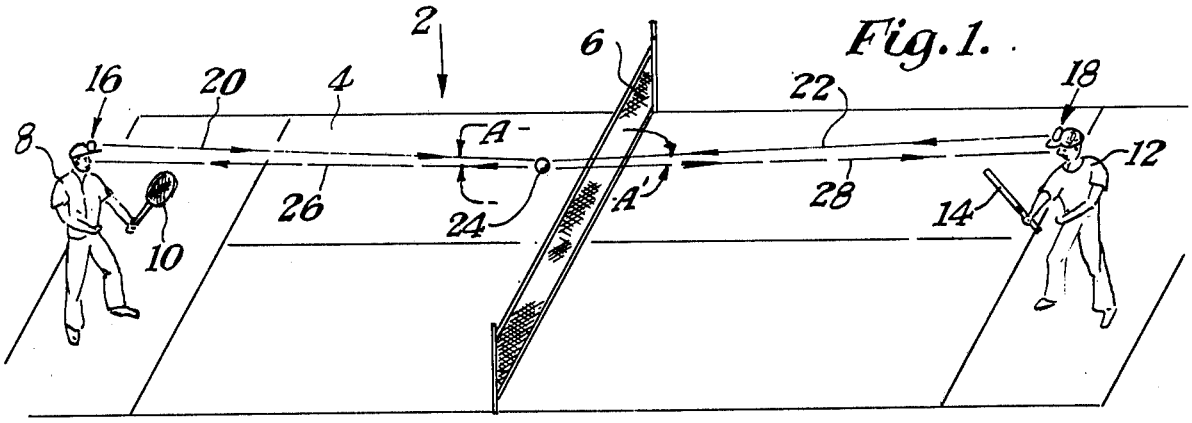
FIG. 1 is an illustration of use of the ball game method and apparatus for tracking a tennis ball in the darkness.

Referring now to FIG. 1 of the drawing illustrating the gaming method for playing a tennis game in the darkness, other games may use the same method and apparatus, the tennis game is generally designated by numeral 2. The tennis game includes a tennis court 4 and a tennis net 6. The first player is designated by numeral 8 and is carrying tennis racquet 10, and a second player is designated by numeral 12 and is carrying tennis racquet 14. The players carry an electromagnetic wave producing device 16 and 18. Each wave producing device provides an output beam shown as line 20 and 22 respectively. The output beam may be produced by any electromagnetic wave making device, such as a light bulb. The ball 24 is a reflective ball that reflects the output beams 20 and 22 to produce the reflective beams 26 and 28 respectively.

Figure 2:
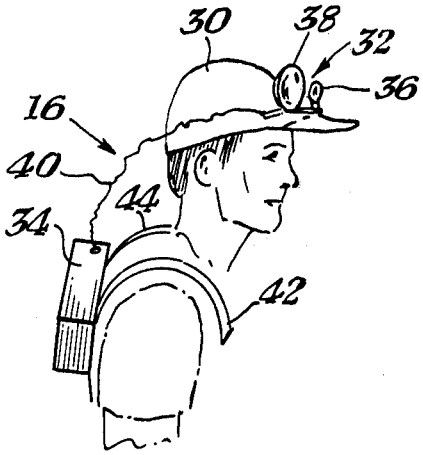
FIG. 2 is an isometric view of the night ball game electromagnetic wave producing device.
Figure 3:
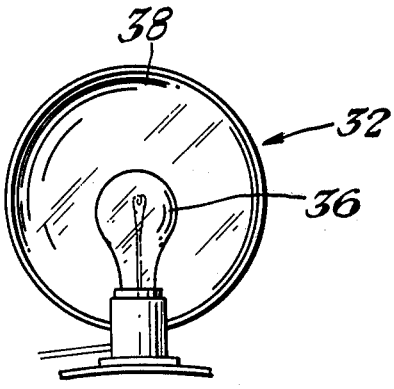
FIG. 3 is a front view of a portion of the device as shown in FIG. 2.

The electromagnetic wave output devices 16 and 18 include as shown in FIGS. 2 and 3, cap 30, and electromagnetic wave producing device 32 connected to the cap, and a power source 34, connected to the electromagnetic wave producing device 32. The light beam from the wave producing device 32 is transmitted outwardly in the general direction of a highly reflective ball 24 in play over the tennis court, as shown in FIG. 1. The transmitter light beams 20 and 22 come in contact with the ball 24 and provide a visible reflected light beam 26 and 28 respectively. The angle, illustrated by letter A and A′ in FIG. 1, between the transmitted light beams and the reflective light beams is small because the light source is placed on the players' caps near the eyes of each player. The angles A and A′ are less than 40° and are preferrably between 5° and 15°. The small reflective angle increases the candle power of the reflective beams.

Referring now to FIGS. 2 and 3, the electromagnetic wave producing means or device 32 may include an ordinary lighting element shown by numeral 36 and a reflective shield 38 for restricting the breadth of the output wave and increasing the output wave's intensity. The wave producing device 32 is connected to a cap 30.

The lighting element 36 may be connected by wire 40 to a power pack 34 held on the player's back by shoulder straps 42 and 44. The reflecting means 38 may be sized to restrict the output wave to a large area that is equal to the width of a player's peripheral vision. The size of the reflector 34 may be shaped and sized to narrow the light beam in order to make the game more competitive by making it harder to keep the reflective ball in the light beam. The use of a narrow light beam requires the player to concentrate on keeping the ball within the beam so that he does not lose the location of the ball in the darkness during the game play.

Figure 4:
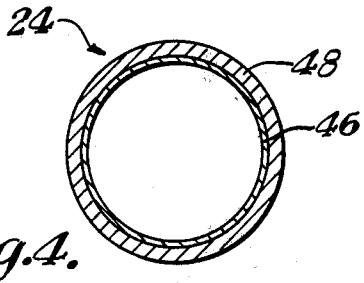
FIG. 4 is a cross-sectional view of a ball with a reflective coating.

Referring now to FIG. 4, the tennis ball 24 is shown with a normal body portion 46 with a coating 48 on the outside of the ball. The coating may include reflective paint or may preferably include retroreflective materials such as glass bead means that are well known in the art. Minnesota Mining and Manufacturing Co. produces many reflective and retroreflective products such as CODIT white reflective liquid.

Figure 5:
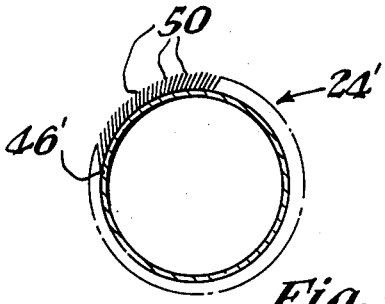
FIG. 5 is a cross-sectional view of a ball with reflective fibers.

FIG. 5 illustrates ball 24' having a normal body 46' with a plurality of reflective fibers 50 connected to the outside of the ball in order to provide the reflectivity necessary to provide the reflective wave beam or light beam from the ball during play in the darkness.

Figure 6:
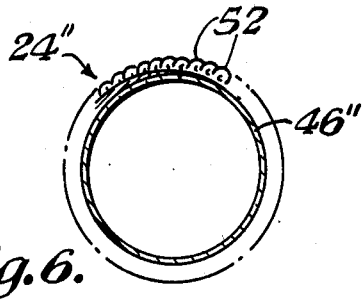
FIG. 6 is a cross-sectional view of a ball with a reflective woven outer layer.

Referring now to the illustration in FIG. 6, the ball 24'' has a body 46'' in which the outer layer may be a woven reflective material 52.

Figure 7:
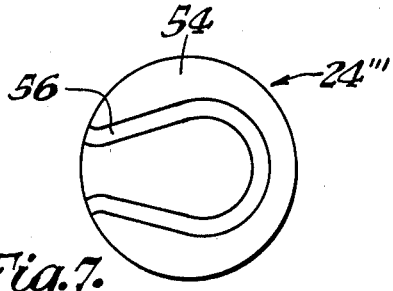
FIG. 7 is a tennis ball with reflective means in the seam areas.

In FIG. 7, the tennis ball 24''' has an ordinary tennis ball outer cover 54 with seam 56. The seam 56 may be filled with a reflective or retroreflective material or tape.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A game method involving the movement of a retro-reflective projectile and a directable visual output means by at least one player for directing the visual output means to track the projectile during play in the dark comprising the steps of:

first providing a generally retro-reflective projectile that is moved back and forth relative to a player during play, then providing directable visual output means, placing said visual output means adjacent at least one of the players of the game for direction control by the player, directing a visual beam from said visual output means in the direction of said retro-reflective projectile during play to provide a visible retro-reflective beam from said retro-reflective projectile to the player to make the moving said retro-reflective projectile visible to the player in the darkness to allow the player to make contact with said retro-reflective projectile for gaming purposes.

2. A game method of playing in the dark comprising the steps as set forth in claim 1 including:

said visual output means is a light means producing at least a beam of light, attaching said visual output means to each player to provide in order to direct the visual beam to said retro-reflective projectile and the retroreflected beam into the eyes of the player attached to said visual output means whereby a moving player may skillfully track the moving projectile.

3. A game tracking apparatus for a moving projectile for playing a game in the darkness comprising:

a generally retro-reflective projectile for providing the gaming projectile, a visual output means for producing a visual output, said visual output means includes an output element for producing the visual output, a power source connected to said element, and a supporting means connected to said element and power source, said supporting means positioned adjacent a player, said visual output means positionable by the player in relation to said retro-reflective projectile as the projectile moves in flight to provide a retroreflective beam, whereby said visual output is intense enough to provide a visible retro-reflective beam from said retro-reflective projectile back to the player's eyes to allow the player to track the movement of said retro-reflective projectile in the darkness for gaming purposes.

4. A game tracking apparatus for a moving projectile for playing a game in the darkness as set forth in claim 3 wherein:

said output visual means includes a reflective means to restrict the width of said visual output into the form of a beam to provide an additional skill factor in the tracking projectile game.

5. A game tracking apparatus for a moving projectile for playing a game in the darkness as set forth in claim 4 wherein:

said supporting means includes a head connecting means for connecting said element to the player's head to aid in directing the visual output in the direction of the moving said retro-reflective projectile.

6. A game tracking apparatus for a moving projectile for playing a game in the darkness as set forth in claim 4 wherein:

said element is connected to the player's head to direct the visual output in the direction of the projectile.

7. A game tracking apparatus for a moving projectile for playing a game in the darkness as set forth in claim 5 wherein:

said retro-reflective projectile includes seams and a retro-reflective material coating in at least the seams of said projectile.

8. A game tracking apparatus for a moving projectile for playing a game in the darkness as set forth in claim 5 wherein:

said retro-reflective projectile includes a glass bead material at the surface of said retro-reflective projectile.

9. A game tracking apparatus for a moving projectile for playing a game in the darkness as set forth in claim 3 wherein:

said retro-reflective projectile includes a retro-reflective material at the surface of said retro-reflective projectile.

* * * * *